US011520247B2

(12) United States Patent
Lee et al.

(10) Patent No.: US 11,520,247 B2
(45) Date of Patent: Dec. 6, 2022

(54) CONTROLLING CHARGING VOLTAGE

(71) Applicant: Hewlett-Packard Development Company, L.P., Spring, TX (US)

(72) Inventors: Byoungil Lee, Seongnam-si (KR); Jaebeom Yoo, Seongnam-si (KR); Jinman Hong, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/312,088

(22) PCT Filed: Mar. 18, 2020

(86) PCT No.: PCT/US2020/023314
§ 371 (c)(1),
(2) Date: Jun. 9, 2021

(87) PCT Pub. No.: WO2021/071543
PCT Pub. Date: Apr. 15, 2021

(65) Prior Publication Data

US 2022/0026826 A1 Jan. 27, 2022

(30) Foreign Application Priority Data

Oct. 10, 2019 (KR) ..... 10-2019-0125717

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/5037
See application file for complete search history.

(56) References Cited

U.S. PATENT DOCUMENTS 7,630,659 B2 12/2009 Uchitani et al.
8,750,736 B2 6/2014 Nakamura et al.
9,864,307 B2 1/2018 Sengoku et al.
(Continued)

FOREIGN PATENT DOCUMENTS

JP 2006-39099 A 2/2006
JP 2009-151122 A 7/2009
(Continued)

*Primary Examiner* — Arlene Heredia
(74) *Attorney, Agent, or Firm* — Jefferson IP Law, LLP

(57) ABSTRACT

An example image forming apparatus includes a photoconductor, a driving unit to rotate the photoconductor, a charging device, a power unit to apply a charging voltage to the charging device, a current measuring unit to measure a current flowing through the charging device and the photoconductor, and a processor. The processor may determine a charging voltage by controlling the driving unit to rotate the photoconductor at a plurality of different rotational speeds, controlling the power unit to apply at least one test charging voltage to the charging device at each of the plurality of different rotational speeds, and determining a charging voltage based on a current measured at each of the at least one test charging voltage through the current measuring unit, and control the charging voltage according to states of the photoconductor and the charging device, based on a result of the performing of the charging voltage determination process.

13 Claims, 10 Drawing Sheets

(56) References Cited

U.S. PATENT DOCUMENTS

| | | | | |
|---|---|---|---|---|
| 2008/0145075 | A1* | 6/2008 | Toda | G03G 15/0266 399/50 |
| 2018/0101108 | A1 | 4/2018 | Yaguchi | |

FOREIGN PATENT DOCUMENTS

| | | | |
|---|---|---|---|
| JP | 2010-19936 | A | 1/2010 |
| JP | 2014-119527 | A | 6/2014 |
| JP | 2016-71304 | A | 5/2016 |

* cited by examiner

FIG. 4

| $V_n$ | $Y_n$ | $X_n$ | $V_n$ | Fitting Results | Resistance |
|---|---|---|---|---|---|
| 0.1675 | 40.0 | 238.8 | 1362 | A = 2.76<br>B = 2.10<br>C =618 | $R_{CR}$ = 2.10MΩ<br>$R_{opc}$ = 8.24MΩ<br>$R_{CR}/R_{opc}$ = 0.255 |
| 0.1675 | 35.6 | 212.5 | 1280 | | |
| 0.1675 | 31.3 | 186.9 | 1198 | | |
| 0.1675 | 26.8 | 160.0 | 1116 | | |
| 0.3350 | 72.0 | 214.9 | 1362 | | |
| 0.3350 | 64.1 | 191.3 | 1280 | | |
| 0.3350 | 56.0 | 167.2 | 1198 | | |
| 0.3350 | 48.1 | 143.6 | 1116 | | |

FIG. 5

| $R_{opc}$ [MΩ] | V600_$R_{opc}$ [V] |
|---|---|
| 7.0 | 1226 |
| 7.2 | 1229 |
| 7.4 | 1233 |
| 7.6 | 1236 |
| 7.8 | 1240 |
| 8.0 | 1243 |
| 8.2 | 1246 |
| 8.4 | 1250 |
| 8.6 | 1253 |
| 8.8 | 1257 |
| 9.0 | 1260 |
| 9.2 | 1263 |
| 9.4 | 1267 |
| 9.6 | 1270 |
| 9.8 | 1274 |
| 10.0 | 1277 |

FIG. 6

| $R_{CR}/R_{opc}$ | $\Delta V_R_{CR}$ [V] |
|---|---|
| 0.00 | 0 |
| 0.02 | 8 |
| 0.04 | 16 |
| 0.06 | 24 |
| 0.08 | 32 |
| 0.10 | 40 |
| 0.12 | 48 |
| 0.14 | 56 |
| 0.16 | 64 |
| 0.18 | 72 |
| 0.20 | 80 |
| 0.22 | 88 |
| 0.24 | 96 |
| 0.26 | 104 |
| 0.28 | 112 |
| 0.30 | 120 |

CONTROLLING CHARGING VOLTAGE

BACKGROUND

An image forming apparatus using an electrophotographic method may form an electrostatic latent image on a photoconductor after charging the photoconductor and exposing an image forming area. Toner is supplied to the electrostatic latent image to form a visible toner image on the photoconductor. The toner image is transferred via an intermediate transfer medium or directly to a print medium and the transferred toner image is fixed on the print medium. A charging roller may be used to charge a surface of the photoconductor. By applying a charging voltage to a charging roller, charges move to a surface of the photoconductor via the charging roller to charge the photoconductor.

BRIEF DESCRIPTION OF DRAWINGS

Various examples will be described below by referring to the following figures.

FIG. 4 illustrates results of rotating a photoconductor at two rotational speeds and application of a plurality of test charging voltages at each of the two rotational speeds to measure a current and calculating resistances of the photoconductor and a charging device according to an example;

FIG. 5 illustrates a charging voltage at respective resistances of a photoconductor to be applied to generate a surface electric potential of the photoconductor of 600 V according to an example;

FIG. 6 illustrates an additional charging voltage according to a ratio of a resistance of a charging device with respect to a photoconductor resistance, wherein the additional charging voltage is to be additionally applied to generate a surface electric potential of the photoconductor of 600 V, according to an example;

DETAILED DESCRIPTION OF EXAMPLES

Figure 1:
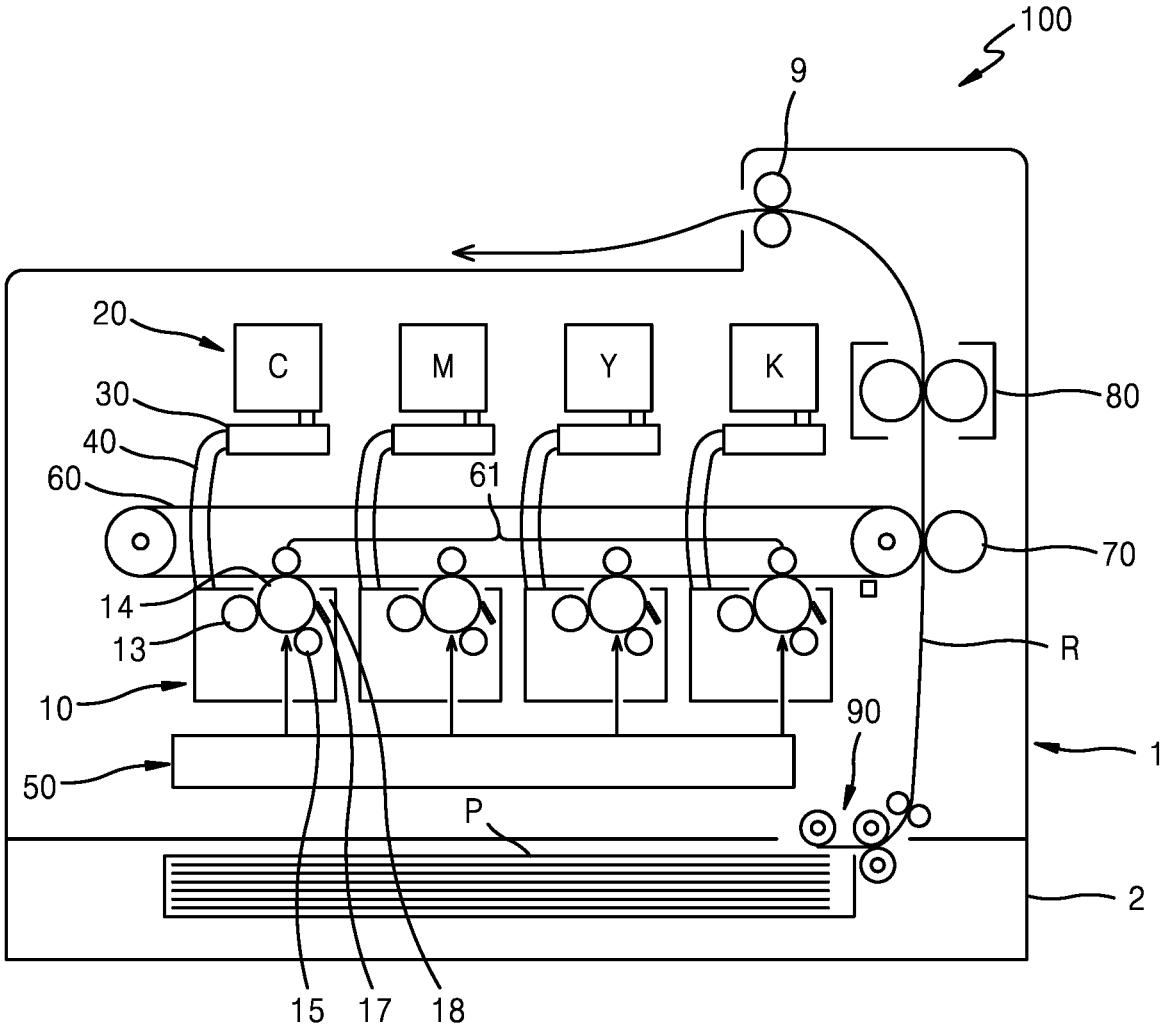
FIG. 1 illustrates an image forming apparatus according to an example.

Hereinafter, various examples will be described with reference to the accompanying drawings. Like reference numerals in the specification and the drawings denote like elements, and thus a redundant description may be omitted.

FIG. 1 illustrates an image forming apparatus according to an example.

Referring to FIG. 1, an image forming apparatus 100 may print a color image by using an electrophotographic developing method. A developing device 10 may include a photoconductor 14, on a surface of which an electrostatic latent image may be formed, and a developing roller 13 to develop the electrostatic latent image to a visible toner image by supplying a developer to the electrostatic latent image. A photosensitive drum is an example of the photoconductor 14, and may be an organic photo conductor (OPC). A charging roller is an example of a charging device 15 that charges the photoconductor 14 to have an appropriate level of surface electric potential. The developing device 10 may further include a cleaning member 17 or the like, which removes a developer remaining on the surface of the photoconductor 14 after an intermediate transfer process. Waste developer may be accommodated in a waste developer container 18.

A developer accommodated in a developer cartridge 20 may be supplied to the developing device 10. A developer supplying unit 30 that receives a developer from the developer cartridge 20 and supplies the same to the developing device 10 may be connected to the developing device 10 via a supply pipe line 40. The developer accommodated in the developer cartridge 20 may be toner.

An exposure device 50, such as a laser scanning unit (LSU), forms an electrostatic latent image on the photoconductor 14 by irradiating the photoconductor 14 with light modulated in correspondence with image information.

A transfer unit transfers the toner image formed on the photoconductor 14 to a print medium P, and may be a transfer unit operating using an intermediate transfer method. For example, the transfer unit may include an intermediate transfer medium 60, an intermediate transfer roller 61, and a transfer roller 70. An intermediate transfer belt is an example of the intermediate transfer medium 60, to which the toner image developed on the photoconductor 14 of a plurality of developing devices 10 is transferred, and may temporarily accommodate the toner image. An intermediate transfer bias voltage to intermediately transfer the toner image developed on the photoconductor 14 to the intermediate transfer medium 60 may be applied to a plurality of intermediate transfer rollers 61. The transfer roller 70 may be positioned to face the intermediate transfer medium 60. A transfer bias voltage for transferring the toner image transferred to the intermediate transfer medium 60 to the print medium P may be applied to the transfer roller 70.

A fuser 80 may apply heat and/or pressure to the toner image transferred onto the print medium P, thereby fusing the toner image on the print medium P.

According to the example described above, the exposure device 50 may form the electrostatic latent image on the photoconductor 14 by scanning a plurality of lights respectively modulated with image information of a plurality of colors, onto the photoconductor 14 of the developing device 10. The electrostatic latent image of the photoconductor 14 of the plurality of developing devices 10 may be developed to a visible toner image by using cyan (C), magenta (M), yellow (Y), and black (K) developers supplied from a plurality of developer cartridges 20 to the plurality of developing devices 10. The developed toner images may be sequentially intermediately transferred to the intermediate transfer medium 60. The print medium P loaded in a feeding unit 2 combined with a main body 1 may be transported along a feed path R, by a print medium transporting device 90, to be transported between the transfer roller 70 and the intermediate transfer medium 60. The toner image intermediately transferred onto the intermediate transfer medium 60 via the transfer bias voltage applied to the transfer roller 70 may be transferred to the print medium P. As the print medium P passes through the fuser 80, the toner image is fixed on the print medium P by the heat and pressure. The fusing-completed print medium P may be discharged using a discharging roller 9.

Among components of the image forming apparatus 100, the photoconductor 14 and the charging device 15 are used each time when an image forming job is performed. Due to continuous use thereof, an appropriate level of a surface electric potential may not be formed on a surface of the photoconductor 14. For example, as the charging device 15 is continuously used and a resistance of the charging device 15 is increased, the increased resistance may cause a surface electric potential of the photoconductor 14 to be less than a target value and thus toner may also attach to a non-image area, thereby causing unnecessary consumption of toner and degradation in image quality such as background defects. Hereinafter, an example method of controlling a charging voltage applied to the charging device 15 contacting a surface of the photoconductor 14, based on states of the photoconductor 14 and the charging device 15 will be described.

Figure 2:
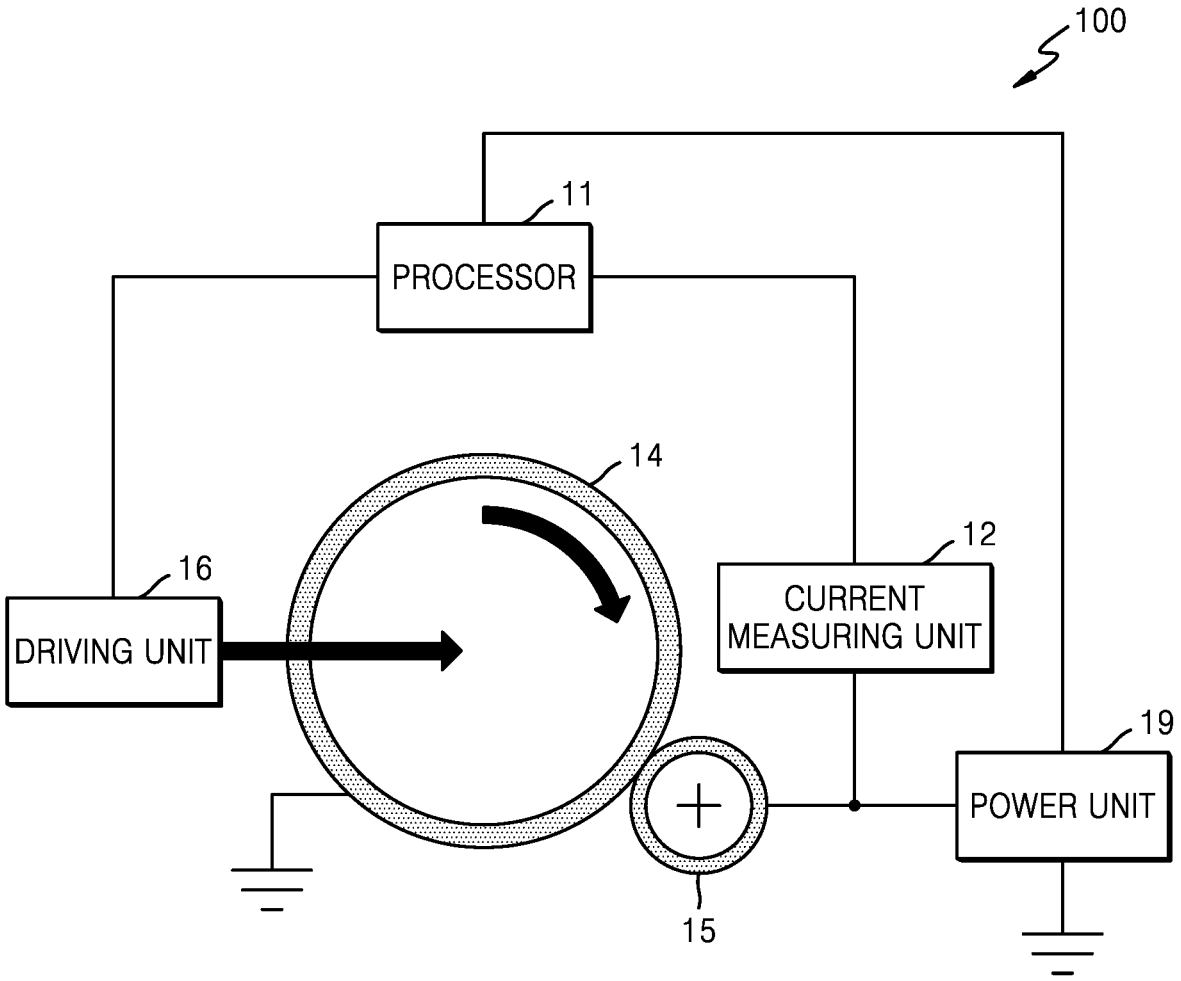
FIG. 2 is a block diagram illustrating an image forming apparatus according to an example.

FIG. 2 is a block diagram illustrating an image forming apparatus according to an example.

Referring to FIG. 2, the image forming apparatus 100 may include a processor 11, a current measuring unit 12, the photoconductor 14, the charging device 15, a driving unit 16, and a power unit 19.

In image forming, the photoconductor 14 may be charged using the charging device 15 and an image forming area may be exposed to form an electrostatic latent image. A toner image formed by supplying toner to the electrostatic latent image may be transferred to an intermediate transfer medium or a print medium.

The driving unit 16 may rotate the photoconductor 14. The driving unit 16 may include a driving motor and a driving gear.

The charging device 15 may charge a surface of the photoconductor 14 to a certain electric potential. The charging device 15 may be in the form of a charging roller contacting the surface of the photoconductor 14.

The power unit 19 may apply a charging voltage to the charging device 15. The power unit 19 may generate a charging voltage for charging the photoconductor 14, and may apply a direct current voltage to the charging device 15 by adjusting an amplitude of the charging voltage.

The current measuring unit 12 may measure a current flowing through the charging device 15 and the photoconductor 14 according to a charging voltage.

The processor 11 may perform a charging voltage determination process to determine a charging voltage at which a surface electric potential of the photoconductor 14 may be generated up to a target value.

For example, the processor 11 may control the driving unit 16 to rotate the photoconductor 14 at a plurality of different rotational speeds and control the power unit 19 to apply at least one test charging voltage to the charging device 15 at each of the plurality of rotational speeds. The processor 11 may control the power unit 19 to apply, to the charging device 15, test charging voltages that differ by equal amounts from a reference test charging voltage, at at least one of the plurality of rotational speeds. The processor 11 may determine a charging voltage, at which a surface electric potential of the photoconductor 14 may be generated up to a target value, based on a current measured at respective test charging voltages at the plurality of rotational speeds through the current measuring unit 12.

The processor 11 may perform a charging voltage determination process during a period in which the image forming apparatus 100 does not perform image forming. When a period during which the image forming apparatus 100 does not perform image forming is equal to or greater than a certain period or when the image forming apparatus 100 has performed image forming a certain number of times or more or on a certain number of sheets or more, the processor 11 may perform a charging voltage determination process. Alternatively, when one of the photoconductor 14 or the charging device 15 is replaced, the processor 11 may perform a charging voltage determination process. Hereinafter, a principle and example manner of a charging voltage determination process will be described.

$$V=V_{OPC}+R_{CR}I+V_C \quad \text{Equation 1}$$

In Equation 1, V is a charging voltage applied to the charging device 15, $V_{OPC}$ is a surface electric potential of the photoconductor 14, $R_{CR}$ is a resistance of the charging device 15, I is a current flowing through the charging device 15, and $V_C$ is a term dependent on a layer thickness of the photoconductor 14, a resistance of the charging device 15, temperature, and humidity.

$$V_{OPC} = \frac{\sigma_f d}{\varepsilon} \quad \text{Equation 2}$$

In Equation 2, $\sigma_f$ is a surface charging density of the photoconductor 14 after the photoconductor 14 is charged, d is a layer thickness of the photoconductor 14, and ε denotes a dielectric constant of a layer of the photoconductor 14.

By representing a surface charging density of the photoconductor 14 by a charging current, a relationship between a surface electric potential of the photoconductor 14 and the charging current may be calculated.

$$V_{OPC} = \frac{\sigma_f d}{\varepsilon} = \frac{(\sigma_f - \sigma_i)d}{\varepsilon} + \frac{\sigma_i d}{\varepsilon} = \frac{(\sigma_f - \sigma_i)vLd}{\varepsilon vL} + \frac{\sigma_i d}{\varepsilon} = \frac{Id}{\varepsilon vL} + \frac{\sigma_i d}{\varepsilon} \quad \text{Equation 3}$$

In Equation 3, $\sigma_i$ denotes a surface change density of the photoconductor 14 before the photoconductor 14 is charged, v denotes a linear speed of a surface of the photoconductor 14 (a rotational speed of the photoconductor 14), and L denotes an axial length of the charging device 15.

Here, by considering the resistance of the photoconductor 14 ($R_{OPC}$) as a coefficient of a charging current, the following equations may result.

$$R_{OPC} = \frac{d}{\varepsilon vL} \quad \text{Equation 4}$$

$$V_{OPC} = R_{OPC}I + \frac{\sigma_i d}{\varepsilon} \quad \text{Equation 5}$$

By summarizing the equations by substituting Equation 5 into Equation 1, the following equation may be obtained.

$$V=(R_{OPC}+R_{CR})I+C \quad \text{Equation 6}$$

In Equation 6, C denotes an intercept that depends on a layer thickness of the photoconductor 14, a resistance of the charging device 15, temperature, and humidity.

According to the above equations, a relationship between a charging voltage and a charging current is expressed. When measuring a charging current by applying one charging voltage, a total resistance which is a sum of a resistance of the photoconductor 14 and a resistance of the charging device 15 may be measured from a resistance, at which the above current is measured.

However, to generate a surface electric potential of the photoconductor 14 of a target value, since amplitudes of charging voltages respectively required by the resistance of the photoconductor 14 ($R_{OPC}$) and the resistance of the charging device 15 ($R_{CR}$) are different, it is difficult to calculate a charging voltage for forming a surface electric potential of the photoconductor 14 of a target value only by measuring a charging current at one rotational speed.

To address this difficulty, a charging current may be measured from a combination of a plurality of rotational speeds of the photoconductor 14 and a plurality of charging voltages. The resistance of the photoconductor 14 ($R_{OPC}$) and the resistance of the charging device 15 ($R_{CR}$) may be calculated from a charging current measured as described above. Equation 6 may be transformed as below.

$$V = (R_{OPC} + R_{CR})I + C = \left(\frac{d}{\varepsilon v L} + R_{CR}\right)I + C = \frac{d}{\varepsilon L}\frac{I}{v} + R_{CR}I + C \quad \text{Equation 7}$$

This may be represented again by a function of a charging voltage, in which a rotational speed of the photoconductor 14 and a measured charging current are included as two independent variables.

$$V = AX + BY + C \quad \text{Equation 8}$$

$$\text{Here, } A = \frac{d}{\varepsilon L},\ B = R_{CR},\ X = \frac{I}{v}, \text{ and } Y = I.$$

By calculating a charging current at respective charging voltages at a plurality of rotational speeds of the photoconductor 14, A and B may be calculated respectively by using the above equation. Regarding measurement data obtained by measuring a charging current by applying several charging voltages at a plurality of rotational speeds of the photoconductor 14, $V_n$ denotes a charging voltage (n=0, 1, 2, 3, . . . ) for measuring a charging current, $X_n$ denotes $I_n/v_n$ when applying each charging voltage ($v_n$ is a rotational speed of the photoconductor 14 when a charging voltage is applied), and $Y_n$ is a charging current ($I_n$) measured when each charging voltage is applied.

By using $V_{m\delta v}$=AX+BY+C as a regression equation, as a result of regression, a coefficient of $X_n$ may be a value proportional to a layer thickness of the photoconductor 14, and a coefficient of $Y_n$ may be a resistance of the charging device 15 ($R_{CR}$), and the resistance of the photoconductor 14 ($R_{OPC}$) and the resistance of the charging device 15 ($R_{CR}$) may be separately measured.

In an example charging voltage determining method by using the resistance of the charging device 15 ($R_{CR}$) calculated as above, respective charging voltages required for a target value of a surface electric potential of the photoconductor 14 according to the resistance of the photoconductor 14 ($R_{OPC}$) and a ratio of the resistance of the charging device 15 with respect to the resistance of the photoconductor 14 ($R_{CR}/R_{OPC}$) may be measured in advance. The power unit 19 may be controlled such that, when controlling a charging voltage to perform image forming, the charging voltage that is suitable for a combination of the resistance of the photoconductor 14 ($R_{OPC}$) and the ratio of the resistance of the charging device 15 with respect to the resistance of the photoconductor 14 ($R_{CR}/R_{OPC}$) is searched for to apply the found charging voltage.

The processor 11 may control a charging voltage based on the states of the photoconductor 14 and the charging device 15 based on a result of the performing of the example charging voltage determination process described above. The processor 11 may control a charging voltage according to respective resistances of the photoconductor 14 and the charging device 15 based on a result of the performing of the charging voltage determination process. The result of the performing of the charging voltage determination process may be a matching table of charging voltages required for a target value of a surface electric potential of the photoconductor 14, the charging voltages being measured in advance according to the resistance of the photoconductor 14 and the ratio of the resistance of the charging device 15 with respect to the resistance of the photoconductor 14. The processor 11 may control a charging voltage when the image forming apparatus 100 performs image forming.

Figure 3:
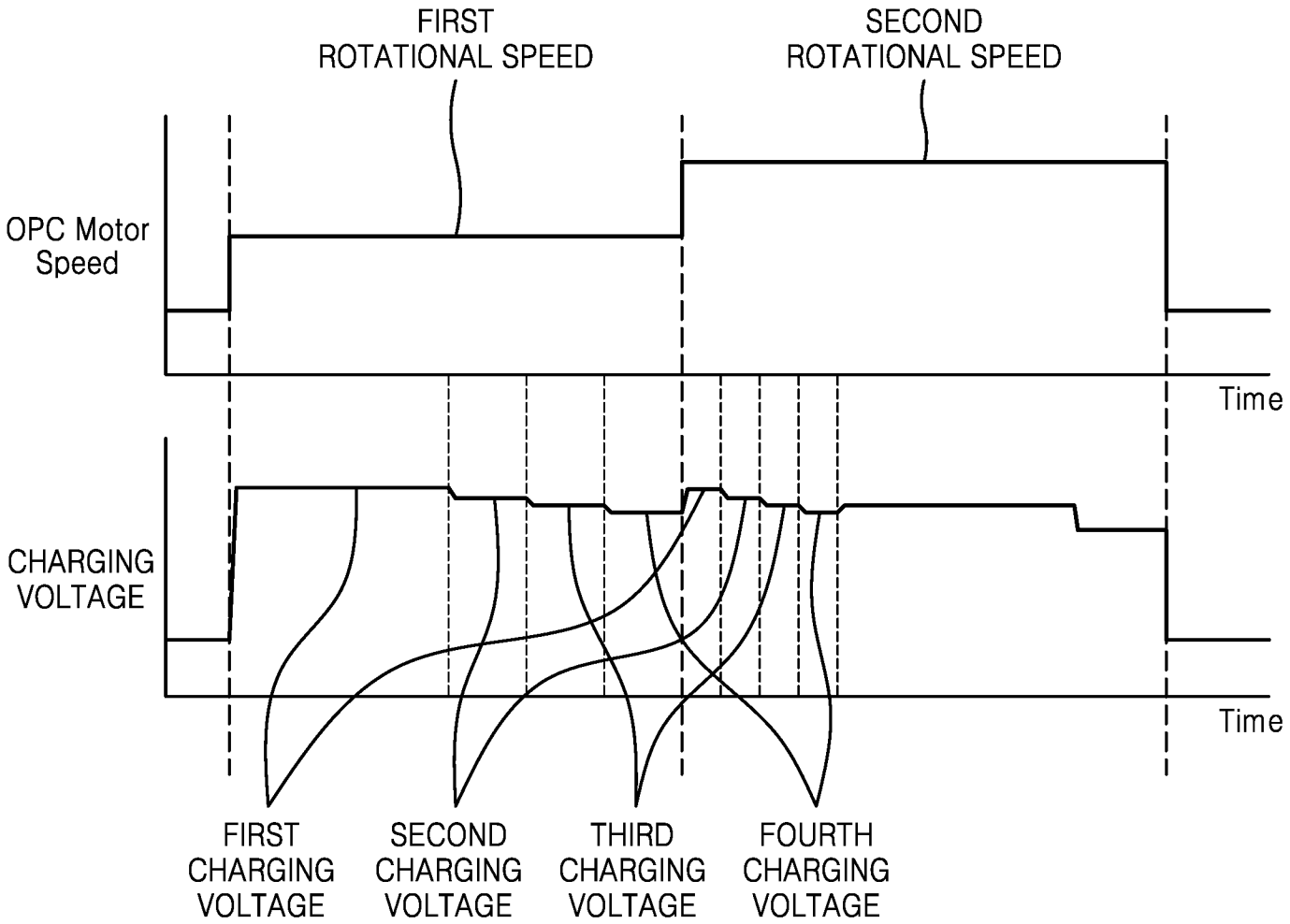
FIG. 3 illustrates a charging voltage determination process according to an example.

FIG. 3 illustrates a charging voltage determination process according to an example.

Referring to FIG. 3, the driving unit 16 rotating the photoconductor 14 operates at two motor speeds such that the photoconductor 14 is respectively rotated at two rotational speeds. Four charging voltages are applied as test charging voltages at each rotational speed. For example, a first rotational speed may correspond to half of a rotational speed of the photoconductor 14 during normal printing, that is, half of a linear speed of a surface of the photoconductor 14. A second rotational speed may correspond to the rotational speed of the photoconductor 14 during normal printing, that is, the linear speed of the surface of the photoconductor 14. A first charging voltage may be a standard charging voltage during normal printing. A second charging voltage may be a charging voltage reduced by a predetermined voltage from the standard charging voltage. A third charging voltage may be a charging voltage reduced by a predetermined voltage from the second charging voltage. A fourth charging voltage may be a charging voltage reduced by a predetermined voltage from the third charging voltage. The first through fourth charging voltages may decreasingly differ from each other by equal amounts.

As illustrated in FIG. 3, the photoconductor 14 rotates at the two rotational speeds. Four test charging voltages are applied to the charging device 15 at each rotational speed to measure a current through the current measuring unit 12. The measured current may be used to calculate $X_n$, that is, $I_n/v_n$ when each charging voltage is applied ($v_n$ is a rotational speed of the photoconductor 14 when a charging voltage is applied) and $Y_n$, that is, a charging current ($I_n$) measured when each charging voltage is applied. As a result of linear regression performed by using $V_{m\delta v}$=AX+BY+C as a regression equation, a coefficient of $X_n$ may be a value proportional to a layer thickness of the photoconductor 14, and a coefficient of $Y_n$ may be a resistance of the charging device 15 ($R_{CR}$). Accordingly, a resistance of the photoconductor 14 ($R_{OPC}$) and the resistance of the charging device 15 ($R_{CR}$) may be separately measured. In an example charging voltage determining method, by using the resistance of the charging device 15 ($R_{CR}$) calculated as above, respective charging voltages required for a target value of a surface electric potential of the photoconductor 14 according to the resistance of the photoconductor 14 ($R_{OPC}$) and a ratio of the resistance of the charging device 15 with respect to the resistance of the photoconductor 14 ($R_{CR}/R_{OPC}$) may be measured in advance, the power unit 19 may be controlled such that, when controlling a charging voltage to perform image forming, a charging voltage that matches a combination of the resistance of the photoconductor 14 ($R_{OPC}$) and the ratio of the resistance of the charging device 15 with respect to the resistance of the photoconductor 14 ($R_{CR}/R_{OPC}$) is searched for to apply the found charging voltage.

FIG. 4 illustrates results of rotating a photoconductor at two rotational speeds and application of a plurality of test charging voltages at each of the two rotational speeds to measure a current and calculating resistances of the photoconductor and a charging device according to an example. FIG. 5 illustrates a charging voltage at respective resistances of a photoconductor to be applied to generate a surface electric potential of the photoconductor of 600 V according to an example. FIG. 6 illustrates an additional charging voltage according to a ratio of a resistance of a charging device with respect to a photoconductor resistance, wherein the additional charging voltage is to be additionally applied to generate a surface electric potential of the photoconductor of 600 V, according to an example.

Referring to FIGS. 4 through 6, an example is shown in which the photoconductor 14 is rotated at two rotational speeds and four test charging voltages are applied to the charging device 15 at each rotational speed. A rotational speed $v_n$ (m/sec) of the photoconductor 14 when a charging voltage is applied thereto, a charging current $Y_n=I_n$ (μA) measured when each charging voltage is applied, and $X_n=(I_n/v_n)$ when each charging voltage is applied are calculated. A resistance of the photoconductor 14 ($R_{OPC}$) and a ratio of a resistance of the charging device 15 with respect to the resistance of the photoconductor 14 ($R_{CR}/R_{OPC}$) are calculated.

In the above example, a charging voltage corresponding to a surface electric potential of the photoconductor 14 of 600 V may be determined as follows. In FIG. 4, the resistance of the photoconductor 14 ($R_{OPC}$) is 8.24 MΩ (about 8.2 MΩ), and thus, a charging voltage according to the resistance of the photoconductor 14 ($R_{OPC}$), which matches 8.2 MΩ in the matching table of charging voltages required for a target value of the surface electric potential of 600 V in FIG. 5 is 1246 V. Also, as the ratio of the resistance of the charging device 15 to the resistance of the photoconductor 14 ($R_{CR}/R_{OPC}$) in FIG. 4 is 0.255 M Ω (about 0.26 MΩ). From the matching table of charging voltages required for the target value of the surface electric potential of 600 V in FIG. 6, a charging voltage that matches 0.26 MΩ and is based on the resistance of the photoconductor 14 ($R_{OPC}$) and the ratio of the resistance of the charging device 15 to the resistance of the photoconductor 14 ($R_{CR}/R_{OPC}$) is 104 V. Thus, when the image forming apparatus 100 performs image forming, the sum of the two charging voltages identified from the matching tables of the charging voltages, that is, 1350 V (1246 V+104 V), may be applied to the charging device 15 as a charging voltage.

Figure 7:
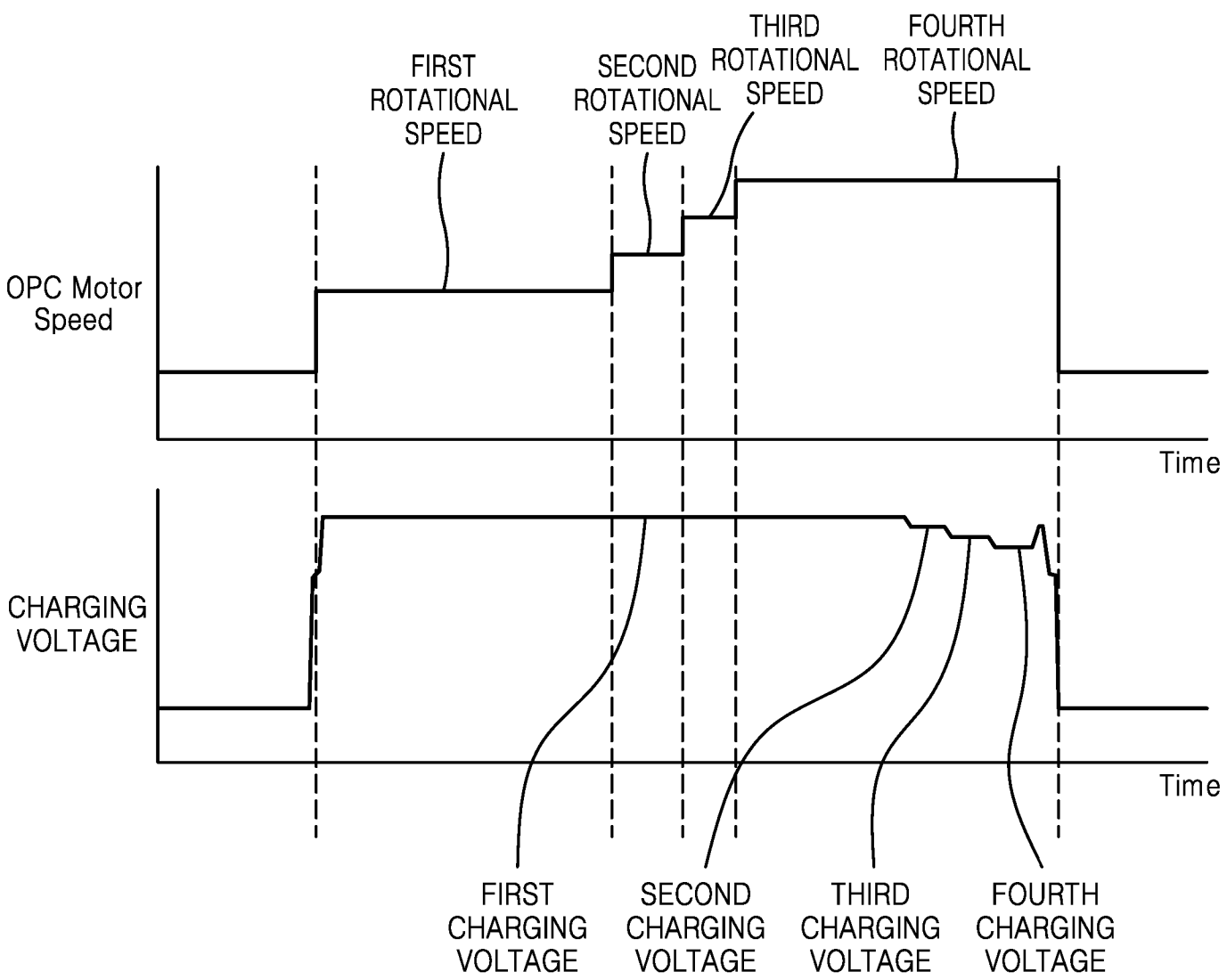
FIG. 7 illustrates a charging voltage determination process according to an example.

FIG. 7 illustrates a charging voltage determination process according to an example.

Referring to FIG. 7, the driving unit 16 rotating the photoconductor 14 operates at four motor speeds, and the photoconductor 14 is rotated at four rotational speeds. While the rotational speed is varied from a first rotational speed to a fourth rotational speed, one charging voltage is maintained. In a section corresponding to the fourth rotational speed, four charging voltages are applied as test charging voltages. For example, in initial and middle stages of the charging voltage determination process, a charging current at the four rotational speeds may be measured while a charging voltage is fixed and only the rotational speed of the photoconductor 14 is gradually increased. In the middle and later stages of the charging voltage determination process, a charging current at the four charging voltages may be measured while the rotational speed of the photoconductor 14 is fixed and the charging voltage is gradually reduced.

By using the current measured using the current measuring unit 12, $X_n$, that is, $I_n/v_n$ when each charging voltage is applied ($v_n$ is a rotational speed of the photoconductor 14 when a charging voltage is applied) and $Y_n$, that is, a charging current ($I_n$) measured when each charging voltage is applied may be calculated. As a result of linear regression performed by using $V_{m\delta v}=AX+BY+C$ as a regression equation, a coefficient of $X_n$ may be a value proportional to a layer thickness of the photoconductor 14, and a coefficient of $Y_n$ may be a resistance of the charging device 15 ($R_{CR}$), and accordingly, a resistance of the photoconductor 14 ($R_{OPC}$) and the resistance of the charging device 15 ($R_{CR}$) may be separately measured. In an example charging voltage determining method by using the resistance of the charging device 15 ($R_{CR}$) calculated as above, respective charging voltages required for a target value of a surface electric potential of the photoconductor 14 according to the resistance of the photoconductor 14 ($R_{OPC}$) and a ratio of the resistance of the charging device 15 with respect to the resistance of the photoconductor 14 ($R_{CR}/R_{OPC}$) may be measured in advance, the power unit 19 may be controlled such that, when controlling a charging voltage to perform image forming, a charging voltage that matches a combination of the resistance of the photoconductor 14 ($R_{OPC}$) and the ratio of the resistance of the charging device 15 with respect to the resistance of the photoconductor 14 ($R_{CR}/R_{OPC}$) is searched for to apply the found charging voltage.

Figure 8:
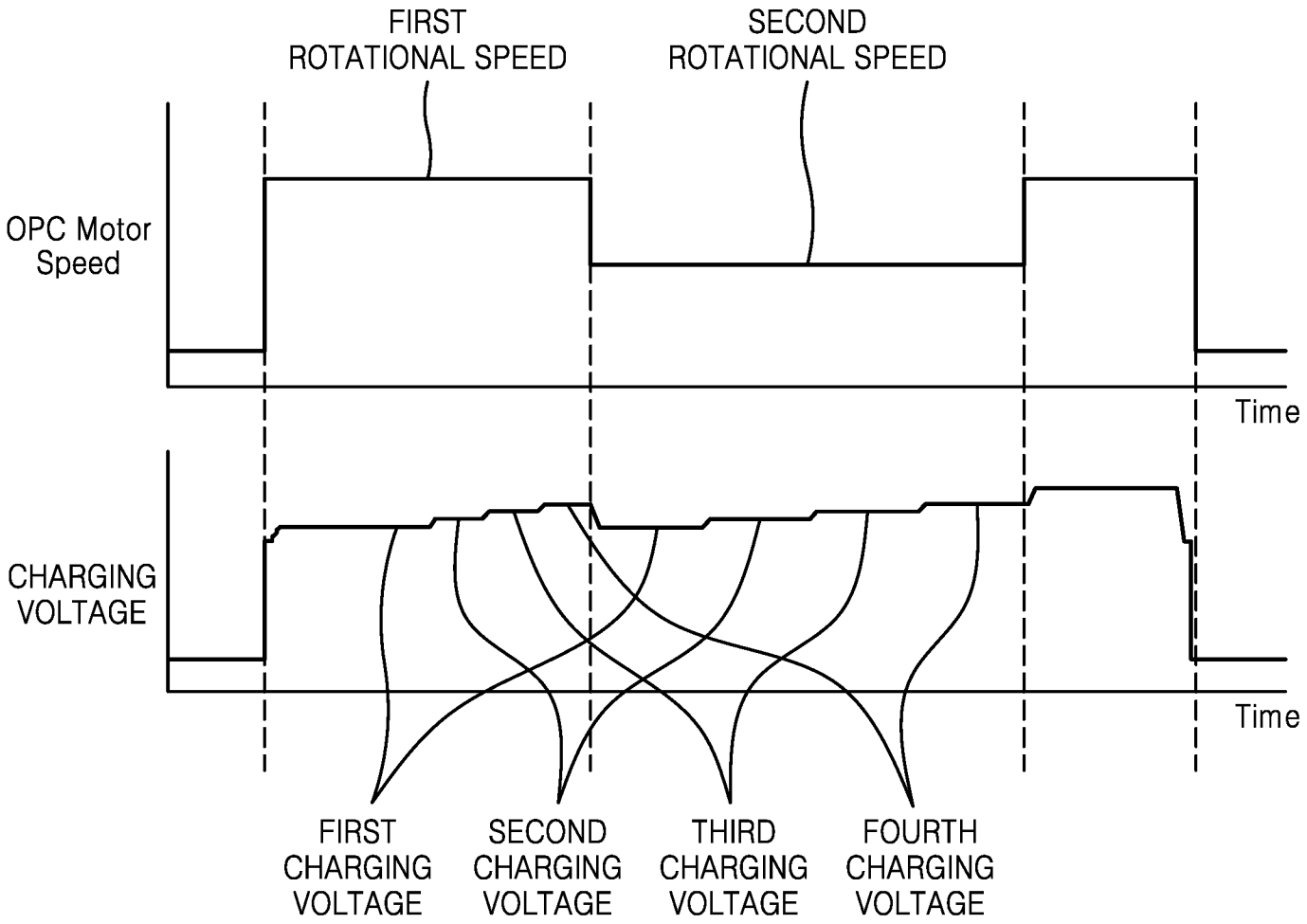
FIG. 8 illustrates a charging voltage determination process according to an example.

FIG. 8 illustrates a charging voltage determination process according to an example.

Referring to FIG. 8, the driving unit 16 rotating the photoconductor 14 operates at two motor speeds such that the photoconductor 14 is rotated at two rotational speeds. Four charging voltages are applied as test charging voltages at each rotational speed. For example, a first rotational speed may correspond to a rotational speed of the photoconductor 14 during normal printing, that is, a linear speed of a surface of the photoconductor 14, and a second rotational speed may correspond to half of the rotational speed of the photoconductor 14 during normal printing, that is, half of the linear speed of the surface of the photoconductor 14. A first charging voltage may be a standard charging voltage during normal printing. A second charging voltage may be a charging voltage increased by a predetermined voltage from the standard charging voltage. A third charging voltage may be a charging voltage increased by a predetermined voltage from the second charging voltage. A fourth charging voltage may be a charging voltage increased by a predetermined voltage from the third charging voltage. The first through fourth charging voltages may increasingly differ from each other in equal increments.

As described above with reference to the example of FIG. 3, the photoconductor 14 may be rotated at two rotational speeds and four test charging voltages may be applied to the charging device 15 at each rotational speed to measure a current through the current measuring unit 12. A charging voltage determination process that determines a charging voltage may be performed based on the measured current.

Figure 9:
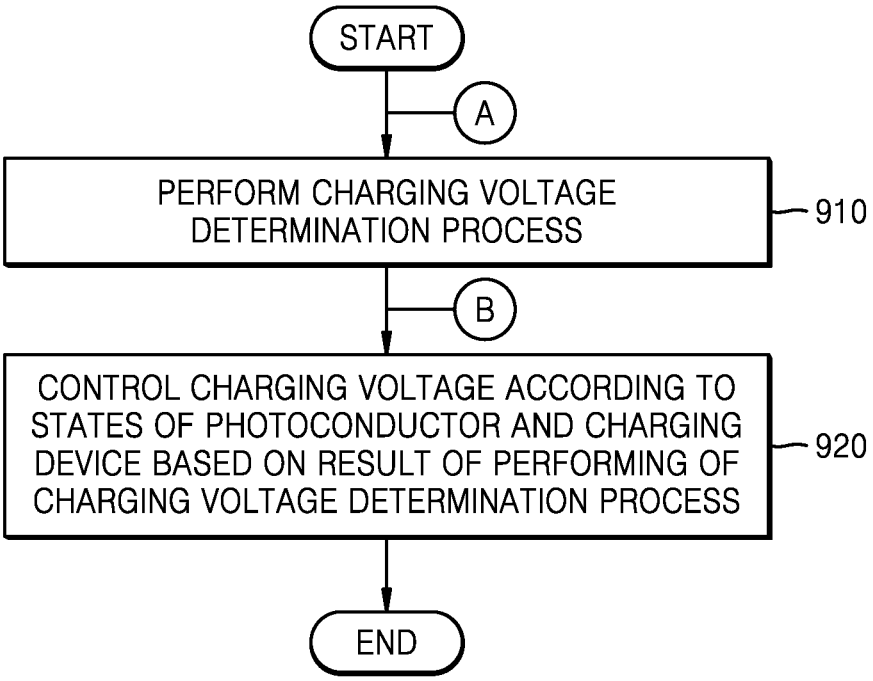
FIG. 9 is a flowchart illustrating a method of controlling a charging voltage according to an example.

FIG. 9 is a flowchart illustrating a method of controlling a charging voltage according to an example.

Referring to FIG. 9, the image forming apparatus 100 may perform a charging voltage determination process in operation 910. The image forming apparatus 100 may perform a charging voltage determination process during a period in which the image forming apparatus 100 does not perform image forming.

When a period during which the image forming apparatus 100 does not perform image forming is equal to or greater than a certain period or when the image forming apparatus 100 has performed image forming a certain number of times or more or on a certain number of sheets or more, the image forming apparatus 100 may perform a charging voltage determination process. Alternatively, when one of the photoconductor 14 or the charging device 15 is replaced, the image forming apparatus 100 may perform a charging voltage determination process.

In operation 920, the image forming apparatus 100 may control a charging voltage according to states of the photoconductor 14 and the charging device 15 based on a result of the performing of the charging voltage determination process. The image forming apparatus 100 may control a charging voltage according to resistances of the photoconductor 14 and the charging device 15 based on the result of the performing of the charging voltage determination process. The result of the performing of the charging voltage determination process may be a matching table regarding charging voltages required for a target value of a surface electric potential of the photoconductor 14, the charging voltages being measured in advance according to the resistance of the photoconductor 14 and the ratio of the resistance of the charging device 15 to the resistance of the photoconductor 14. The image forming apparatus 100 may control a charging voltage when performing image forming.

Figure 10:
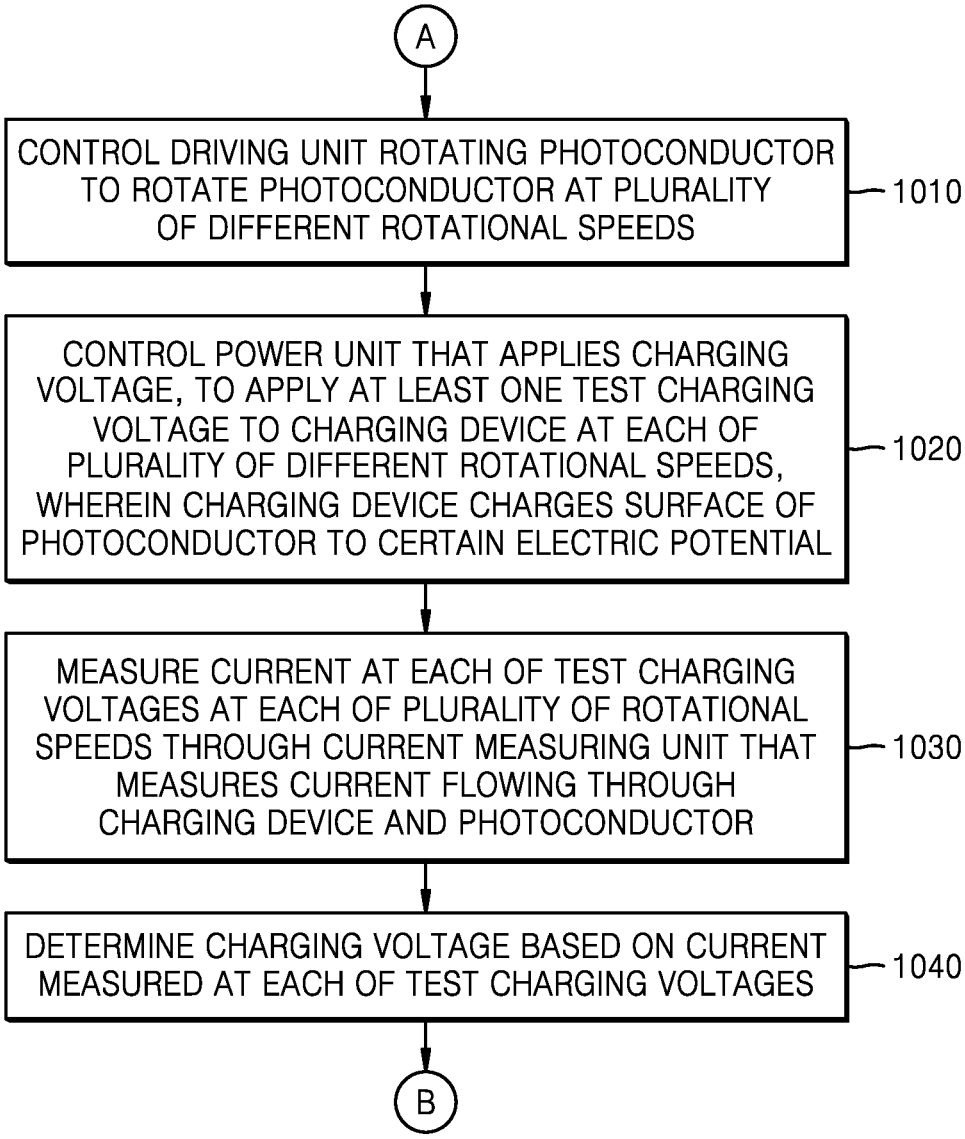
FIG. 10 is a flowchart illustrating a method of determining a charging voltage in a method of controlling a charging voltage according to an example.

FIG. 10 is a flowchart illustrating a method of determining a charging voltage in a method of controlling a charging voltage according to an example.

Referring to FIG. 10, the image forming apparatus 100 may control the driving unit 16 that rotates the photoconductor 14, to rotate the photoconductor 14 at a plurality of different rotational speeds in operation 1010.

In operation 1020, the image forming apparatus 100 may control the power unit 19 applying a charging voltage to apply at least one test charging voltage to the charging device 15 that charges, to a certain electric potential, a surface of the photoconductor 14 at each of the plurality of rotational speeds. The image forming apparatus 100 may control the power unit 19 to apply, to the charging device 15, test charging voltages that differ by equal amounts from a reference test charging voltage, at at least one of the plurality of rotational speeds.

In operation 1030, the image forming apparatus 100 may measure a current for each test charging voltage at each of the plurality of rotational speeds through the current measuring unit 12 that measures a current flowing through the charging device 15 and the photoconductor 14.

In operation 1040, the image forming apparatus 100 may determine a charging voltage at which a surface electric potential of the photoconductor 14 up to a target value may be formed, based on the current measured at each of the plurality of rotational speeds. In an example method of determining a charging voltage by using the resistance of the charging device 15 ($R_{CR}$), respective charging voltages required for a target value of the surface electric potential of the photoconductor 14 according to the resistance of the photoconductor 14 ($R_{OPC}$) and the ratio of the resistance of the charging device 15 with respect to the resistance of the photoconductor 14 ($R_{CR}/R_{OPC}$) may be measured in advance.

An example method of controlling a charging voltage may be implemented in the form of a non-transitory computer-readable storage medium storing instructions or data executable by a computer or a processor. The method of controlling a charging voltage described above may be written as a program executable on a computer, and may be implemented on a general-purpose digital computer operating the above-described program by using a non-transitory computer-readable storage medium. The non-transitory computer-readable storage medium may include a read-only memory (ROM), a random-access memory (RAM), a flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks (SSDs), and any device capable of storing instructions or software, associated data, data files, and data structures and providing instructions or software, associated data, data files, and data structures to a processor or a computer for the processor or the computer to execute the instructions.

What is claimed is:

1. An image forming apparatus comprising:

a photoconductor;

a driving unit to rotate the photoconductor;

a charging device to charge a surface of the photoconductor;

a power unit to apply a charging voltage to the charging device;

a current measuring unit to measure a current flowing through the charging device and the photoconductor according to the charging voltage; and a processor to:

perform a charging voltage determination process of controlling the driving unit to rotate the photoconductor at a plurality of different rotational speeds, control the power unit to apply at least one test charging voltage to the charging device at each of the plurality of different rotational speeds, determine a charging voltage based on a current measured at each of the at least one test charging voltage through the current measuring unit, and control the charging voltage according to states of the photoconductor and the charging device and according to respective resistances of the photoconductor and the charging device based on a result of the performing of the charging voltage determination process.

2. The image forming apparatus of claim 1, wherein the result of the performing of the charging voltage determination process comprises a matching table regarding charging voltages required for a target value of a surface electric potential of the photoconductor, the charging voltages being measured in advance according to a resistance of the photoconductor and a ratio of a resistance of the charging device to the resistance of the photoconductor.

3. The image forming apparatus of claim 1, wherein the processor is further to:

perform the charging voltage determination process during a period during which the image forming apparatus does not perform image forming, and control the charging voltage when the image forming apparatus performs image forming.

4. The image forming apparatus of claim 1, wherein the processor is further to perform the charging voltage determination process when a period during which the image forming apparatus does not perform image forming is equal to or greater than a certain period or when the image forming apparatus has performed image forming a certain number of times or more or on a certain number of sheets or more.

5. The image forming apparatus of claim 1, wherein the processor is further to perform the charging voltage determination process when one of the photoconductor or the charging device is replaced.

6. The image forming apparatus of claim 1, wherein the processor is further to control the power unit to apply, in the charging voltage determination process, test charging voltages of different amplitudes, which differ by equal amounts from a reference test charging voltage, at at least one of the plurality of rotational speeds.

7. A method of controlling a charging voltage of an image forming apparatus, the method comprising:

performing a charging voltage determination process including:

controlling a driving unit rotating a photoconductor to rotate the photoconductor at a plurality of different rotational speeds, controlling a power unit that applies a charging voltage, to apply at least one test charging voltage to a charging device at each of the plurality of different rotational speeds, wherein the charging device charges a surface of the photoconductor, and determining a charging voltage based on a current measured at each of the at least one test charging voltage through a current measuring unit that measures a current flowing through the charging device and the photoconductor; and controlling the charging voltage according to states of the photoconductor and the charging device and according to respective resistances of the photoconductor and the charging device based on a result of the performing of the charging voltage determination process.

8. The method of claim 7, wherein the result of the performing of the charging voltage determination process comprises a matching table regarding charging voltages required for a target value of a surface electric potential of the photoconductor, the charging voltages being measured in advance according to a resistance of the photoconductor and a ratio of a resistance of the charging device to the resistance of the photoconductor.

9. The method of claim 7, wherein the performing of the charging voltage determination process further comprises performing the charging voltage determination process during a period during which the image forming apparatus does not perform image forming, and wherein the controlling of the charging voltage comprises controlling the charging voltage when the image forming apparatus performs image forming.

10. The method of claim 7, wherein the performing of the charging voltage determination process comprises performing the charging voltage determination process when a period during which the image forming apparatus does not perform image forming is equal to or greater than a certain period or when the image forming apparatus has performed image forming a certain number of times or more or on a certain number of sheets or more.

11. The method of claim 7, wherein the performing of the charging voltage determination process further comprises performing the charging voltage determination process when one of the photoconductor or the charging device is replaced.

12. The method of claim 7, wherein the performing of the charging voltage determination process further comprises controlling the power unit to apply, to the charging device, test charging voltages of different amplitudes, which differ by equal amounts from a reference test charging voltage, at at least one of the plurality of rotational speeds.

13. A non-transitory computer-readable storage medium storing instructions executable by a processor, the non-transitory computer-readable storage medium comprising:

instructions to perform a charging voltage determination process including:

controlling a driving unit rotating a photoconductor to rotate the photoconductor at a plurality of different rotational speeds, controlling a power unit that applies a charging voltage to apply at least one test charging voltage to a charging device at each of the plurality of different rotational speeds, wherein the charging device charges a surface of the photoconductor, and determining a charging voltage based on a current measured at each of the at least one test charging voltage through a current measuring unit that measures a current flowing through the charging device and the photoconductor; and instructions to control the charging voltage according to states of the photoconductor and the charging device and according to respective resistances of the photoconductor and the charging device based on a result of the performing of the charging voltage determination process.

* * * * *